US007587921B2

(12) United States Patent
Bordignon

(10) Patent No.: US 7,587,921 B2
(45) Date of Patent: Sep. 15, 2009

(54) APPARATUS FOR THE PRODUCTION OF WIRE SPRINGS

(75) Inventor: Romeo Bordignon, Cassola (IT)

(73) Assignee: Mollificio Bordignon S.R.L., Rossano Veneto (IT)

( * ) Notice: Subject to any disclaimer, the term of this patent is extended or adjusted under 35 U.S.C. 154(b) by 259 days.

(21) Appl. No.: 11/628,672

(22) PCT Filed: May 30, 2005

(86) PCT No.: PCT/EP2005/052442

§ 371 (c)(1),
(2), (4) Date: Dec. 6, 2006

(87) PCT Pub. No.: WO2005/123299

PCT Pub. Date: Dec. 29, 2005

(65) Prior Publication Data

US 2008/0257003 A1 Oct. 23, 2008

(30) Foreign Application Priority Data

Jun. 15, 2004 (IT) ..... PN2004A0044

(51) Int. Cl.
*B21F 3/02* (2006.01)
*B21F 3/04* (2006.01)

(52) U.S. Cl. ..... 72/142; 72/145

(58) Field of Classification Search ..... 72/135, 72/137, 142, 144, 145, 146, 64–66; 140/92.94
See application file for complete search history.

(56) References Cited

U.S. PATENT DOCUMENTS 6,928,846 B2 * 8/2005 Furuse ..... 72/138
2003/0164019 A1 * 9/2003 Matsuoka ..... 72/137

* cited by examiner

*Primary Examiner*—Dana Ross
*Assistant Examiner*—Debra M Sullivan
(74) *Attorney, Agent, or Firm*—Wenderoth, Lind & Ponack, L.L.P.

(57) ABSTRACT

An apparatus for producing wire springs comprising: a first working station including a wire support and cutting means adapted to cut the wire against the support, a second working station including a rod about which the wire is wound, and clamping means for securing the wire against an end portion of the rod, these means being constituted by two controllable vices arranged in diametrically opposed positions with respect to the axis of the rod. In the portion thereof facing the rod, these vices are so shaped as to show a respective planar or slightly concave surface towards the rod. Wire cutting occurs according to a radial sectioning plane with respect to the support and is arranged so that the spring is cut in a manner that the wire remaining on said support is wound thereabout by an angle greater than 180°.

14 Claims, 4 Drawing Sheets

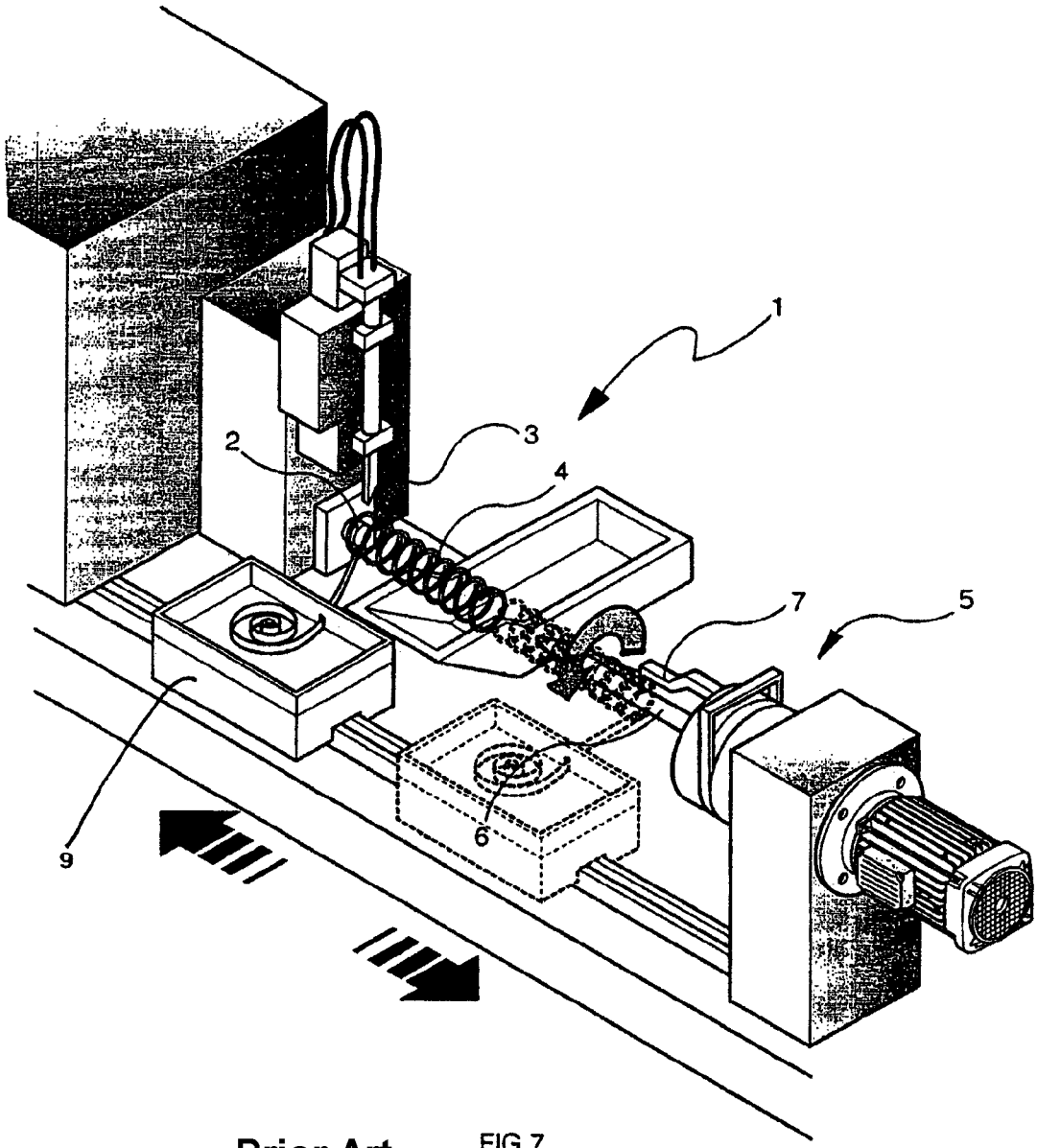
Prior Art FIG.7

APPARATUS FOR THE PRODUCTION OF WIRE SPRINGS

BACKGROUND OF THE INVENTION

1. Field of the Invention

The present invention refers to an apparatus for producing spirally wound, i.e. coiled wire springs of a universally known kind, which are made by appropriately processing and cutting an elongated section of continuous wire, frequently wound into a skein form.

2. Description of the Related Art

In the following description, these springs will be referred to simply as wire springs, i.e. the term "wire spring" is used to indicate and include all springs of the above-cited kind.

Wire springs are largely known to be generally produced by winding about an appropriate rod, which is called a "core" in the technical parlance, a length of continuous wire that is then appropriately cut into individual sections, i.e. discrete springs. The cut end of a just produced spring forms at the same time the cut end of the next spring being formed.

It is well known to all those skilled in the art—and it will in fact be only briefly mentioned here—that an automatic machine for the production of such wire springs comprises in particular (and with special reference to FIG. 7):

- a first working station 1 provided with a substantially cylindrical support member 2 adapted to enable a length of wire 4 to be wound around a certain portion thereof, and cutting means 3 provided at said first working station and adapted to cut said length of wire against said support used as an anvil,
- a second working station 5 provided with a rod 6 for supporting and winding said wire, and means 7 for engaging and clamping a portion of said wire at an end portion of said rod 6,
- a wire carriage 9 adapted to transfer a length of wire from said first working station to said second working station with a movement that is substantially rectilinear and parallel to the direction of the axis X of said rod.

The production of wire springs with such kind of apparatus allows a high degree of manufacturing flexibility, as well as considerable productivity rates. However, this particular machine, along with the wire-working process performed on it, is not free from certain peculiar drawbacks that will be described in greater detail below:

a) A first drawback derives from the fact that the means used to clamp the wire onto the rod (core), and known also as the "claw" in the art, is constituted by a single member that, in order to clamp the wire, must penetrate it and, as a result, must be sharp-pointed; owing to its being used continuously under heavy-duty conditions, this member is subject to rapid wear and tear, so that it must be replaced quite frequently; as an alternative solution, provisions can be taken in order to be able to periodically adjust the pressure of said claw, but even this measure, which does not solve the problem in any permanent, lasting manner, has a drawback in that it requires additional operations to be carried out and the manufacturing process, which is usually fully automated, must be interrupted accordingly, b) A second drawback more specifically relates to the actual way in which said claw works: since it must press against the wire, which is wound around the core, the latter undergoes a lateral bending stress that causes the spring to be wound according to an axis that, as a result, becomes neither stable nor rectilinear, thereby introducing obvious problems as far as the regularity of the springs being produced is concerned.

This drawback becomes increasingly significant as the diameter of the core decreases and the diameter of the wire being worked increases, since, as anyone skilled in the art is well aware of, when the above conditions are amplified accordingly, the need arises for the pressure of the claw onto the wire to be markedly increased, thereby aggravating the working conditions of the core to quite a considerable extent.

c) A third drawback is brought about by the fact that the pressure exerted by the clamping claw unavoidably causes an impression to be left at an end portion of the spring, which tends to introduce some weakening effect in the same spring and may sometimes cause some problems, d) A fourth drawback derives from the fact that this lateral pressure exerted on the first coil of the spring causes—and this is again largely known to all those skilled in the art—said first coil to be shaped so as to show a slight, but measurable ovalness, instead of the desired perfect circularity; even such irregularity tends to quite frequently cause problems in assembling and using the springs.

The state of art regarding the manufacturing processes used to produce spirally wound springs, i.e. coiled wire springs, lists a great variety of technologies and related plants; by mere way of example, the cases may be cited here of the disclosures in the Japanese patent applications nos. JP 06079869 and JP 05082609, as well as the Italian patent no. IT 1.181.049. The latter, in particular, discloses a fully automated process for making coiled wire springs without initial and final stems; however, none of the elements and features disclosed in this patent or, more generally, in the state of the art, enables any of the afore-noted drawbacks and problems to be solved, actually.

BRIEF SUMMARY OF THE INVENTION

It would therefore be desirable, and it is actually a main purpose of the present invention, to provide a means for the production of spirally wound springs, i.e. coiled wire springs, which does completely away with the above-noted drawbacks of prior-art solutions, is capable of being easily and reliably implemented, is not particularly burdensome or demanding from both an economic and a technical point of view, and is further fully automatable.

Within this general object, another purpose of the present invention is to make the invention itself fully applicable to existing automated machines with a minimum extent of just minor modifications to be made on either the machines or the related working process.

Features and advantages of the present invention will anyway be more readily and clearly understood from the description that is given below by way of non-limiting examples with reference to the accompanying drawings.

BRIEF DESCRIPTION OF THE DRAWINGS

FIG. 7 is a view from the outside of the two working stations and the wire carriage arrangement in an apparatus according to the state of the art.

DETAILED DESCRIPTION OF THE INVENTION

With reference to FIGS. 1 to 6, an apparatus for the production of coiled wire springs according to the present invention is substantially comprised of the means and devices that have been described earlier in this description with reference to a prior-art apparatus, to which however following features must be added:

the afore-cited wire clamping or securing means, usually formed by said claw, are normally replaced with a pair of small vices 10, 11 provided, on said second working station of the apparatus, at the two opposite sides of said rod or core 6 on a same plane extending orthogonally to said same rod, and separated from the rod itself by such distance d as to ensure that the first half-coil 4 to be wound is capable of being easily coiled around said rod without interfering with said vices.

Figure 1:
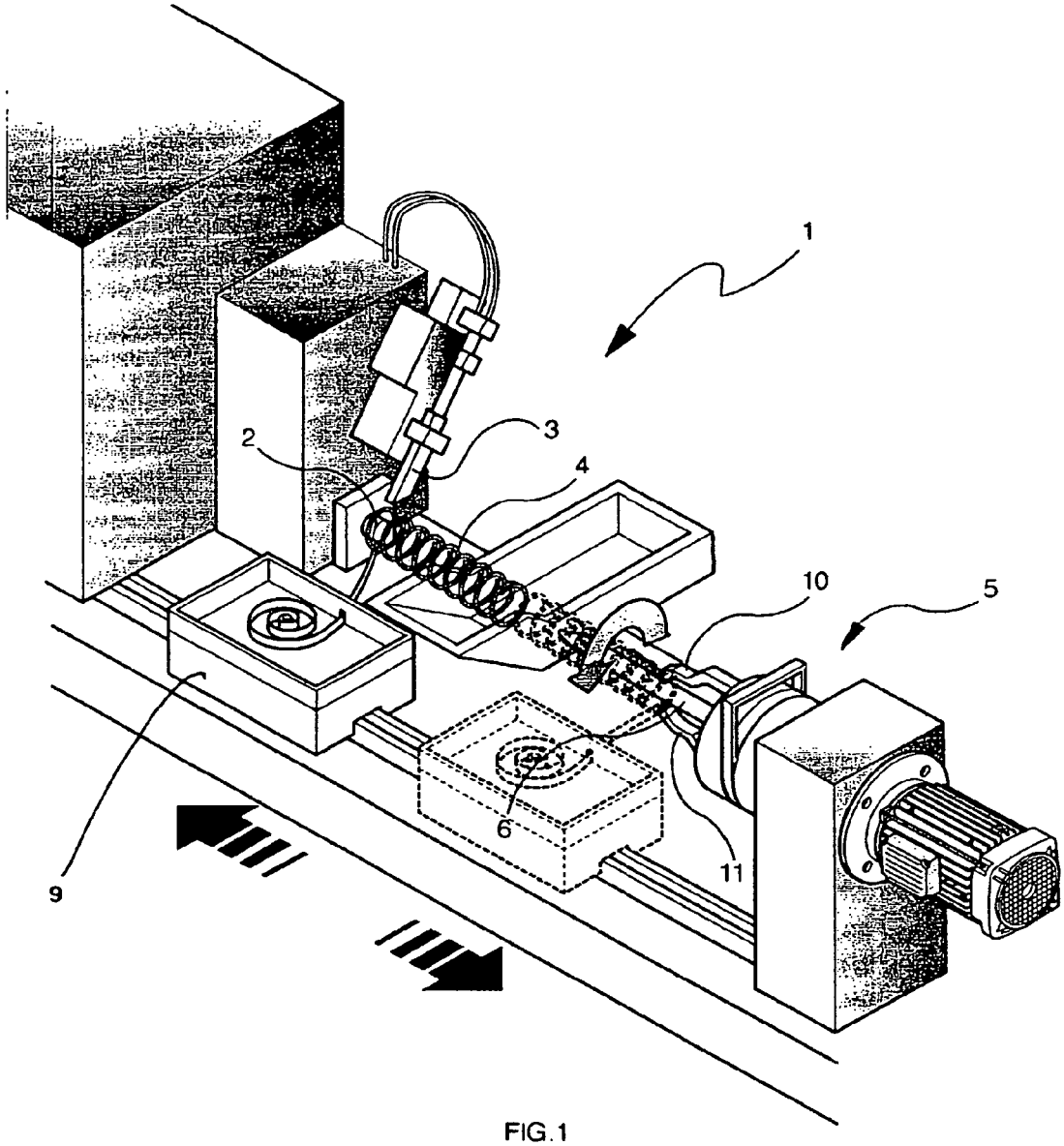
FIG. 1 is a view from the outside of the two working stations and the wire carriage arrangement in an apparatus according to the present invention.
Figure 2:
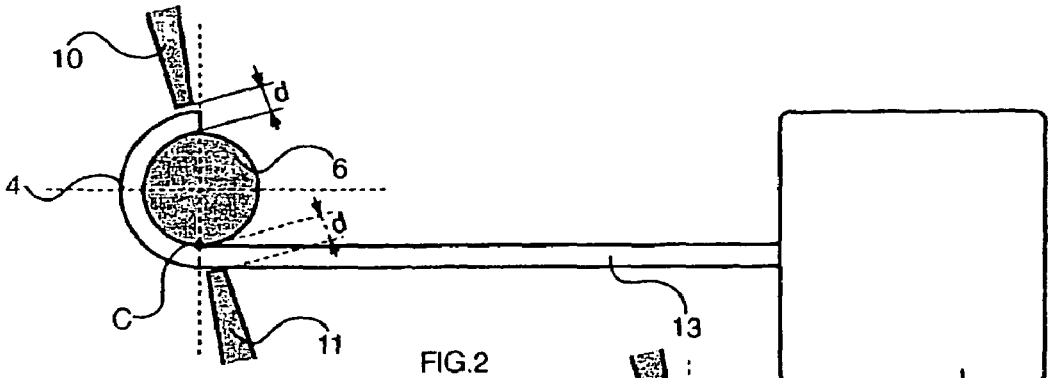
FIG. 2 and FIG. 3 are plane views of the coiling station 5, as viewed substantially from the axis X of the rod or core, in two distinct operating steps of the apparatus shown in FIG. 1, respectively.
Figure 2A:
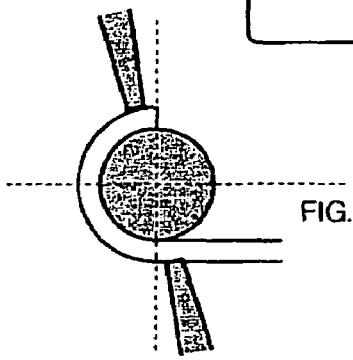
Figure 3:
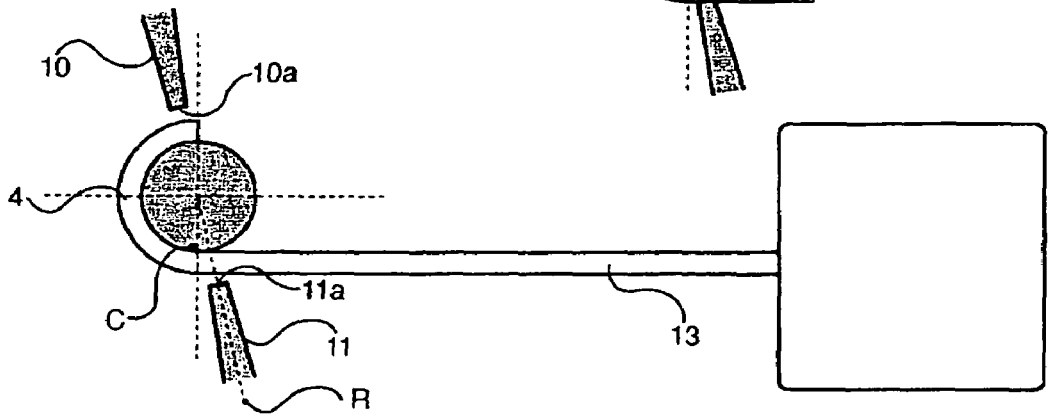

The above-cited vices are preferably made in a mutually symmetrical form, relative to the axis X of said rod, as is shown schematically in FIGS. 2 and 3, and are associated to actuating means of any generally known kind in such a manner as to be able to be actuated into displacing radially towards and away from said rod, as this may be readily understood by comparing the illustrations in FIGS. 2 and 3 with each other.

Both these vices 10, 11 are therefore adapted to be closed, with a synchronous movement, on a length of wire, and preferably on the first half-coil 4 wound around said rod 6 in the second working station 5.

At a certain point during the working process, upon a portion of coil having been transferred from the first working station to the second working station, in which said portion of coil is applied partially wound around the end portion of said rod 6, said two vices 10, 11 are then tightened with a simultaneous movement onto the two opposite sides of said portion of coil, so that the latter is securely clamped on the same rod (FIG. 2).

It may therefore be readily appreciated that this inventive feature enables both drawbacks described under b) and d) earlier in this description to be fully done away with, since the forces that now act on both the half-coil 4 and the underlying rod are no longer a single lateral force, but rather two radial and symmetric forces, so that these forces balance each other automatically as far as the bending stress imparted upon the rod and the ovalization of the initial coil of the wire are concerned.

This particular embodiment allows for an advantageous improvement to be made: with reference to FIG. 3, such improvement consists in shaping these vices 10, 11 so that they are given not a pointed end portion, as in the case of the single claw used in prior-art applications, but rather two end portions 10*a* and 11*a* that, on the side thereof facing the wire, are provided with a smooth, continuous surface, which preferably can be given a slightly concave shape so as to enable it to more effectively adapt to the curvature of the wire on the rod.

By this simple measure of having said end portions 10*a* and 11*a* appropriately shaped to conform the curvature of the wire on the rod, this solution furthermore enables the wire to be kept free of any notch or similar impression, which—as noted above—is on the contrary usually the case with prior-art wire clamping means, since the wire is in this case only pressed on the surface thereof. Furthermore, no risk arises for the rod to be submitted to any undesired bending and deformation stress since, even if the two opposing forces exerted by the two vices are very high, they would nonetheless not give rise to any detrimental effect, owing to the fact that, relative to the same rod, they are wholly opposing and, therefore, cancelling each other, so that the overall effect thereof is nil.

As a result, this enables the drawback noted under c) earlier in this description to be definitively solved.

However, the provision of two mutually opposing vices 10, 11, albeit operated synchronously, i.e. simultaneously, and acting radially on the axis X of the rod 6, owing to them being actually arranged at the two extremes of the outer diameter of the curvature of the first half-coil 4 and this half-coil being wound for no more than half a turn thereabout, would impose said vices to be oriented relative to partly wound half-coil 4 in the way as illustrated schematically in FIG. 3, which shows said first half-coil 4—as viewed along the axis X—prior to the remaining coils of the spring being then wound.

From the illustration in FIG. 3 it can be noticed that, for said vices 10, 11 to be able to be applied with the respective contact areas 10*a* and 11*a* onto a corresponding area of the wire, said contact areas must necessarily arrange themselves in such a manner as to ensure that one of these areas (i.e. the area 11*a* in FIG. 3) will necessarily present itself according to a radial orientation R, to which there does not correspond any contact between said half-coil and the stem therebelow, or—at best—such contact is only partial; as can be most readily appreciated, this situation is quite an unfavourable one, owing to both the fact that a risk is in this way created for the wire to be notched or impressed, since the contact surface thereof no longer corresponds to the contact area 11*a*, and—above all—the fact that said first half-coil 4 is unavoidably deformed.

A further drawback should additionally be considered, which derives from the possibility that, if the wire in correspondence to the radial orientation R of the vice 11 is no longer in contact with the underlying rod, this may jeopardize the actual wire-clamping ability of the remaining vice 10, on which the task of pressing—alone and without any counter-force opposing it—said first half-coil 4 against the rod 6 would then be concentrated.

For this drawback to be done away with, the need arises for a solution to be developed, the aim of which is as follows: even if the second vice 11 is desirably to come entirely into contact with the wire at an area comprised in the already wound half-coil, and since the vice 10 must similarly be in contact with the wire, it is necessary for the first portion of the half-coil 4 to be wound by a sufficiently wide angle, so that both said contact areas 10*a* and 11*a* may rest upon already curved portions of said first half-coil 4.

Figure 4:
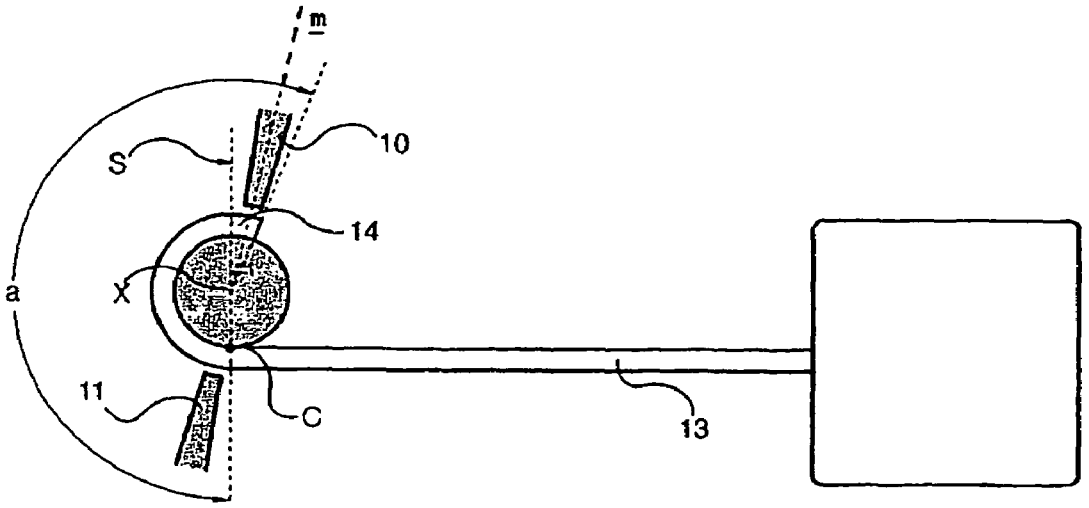
FIG. 4 is a view corresponding to the one appearing in FIG. 3 of a further improved embodiment of the apparatus according to the present invention.
Figure 5:
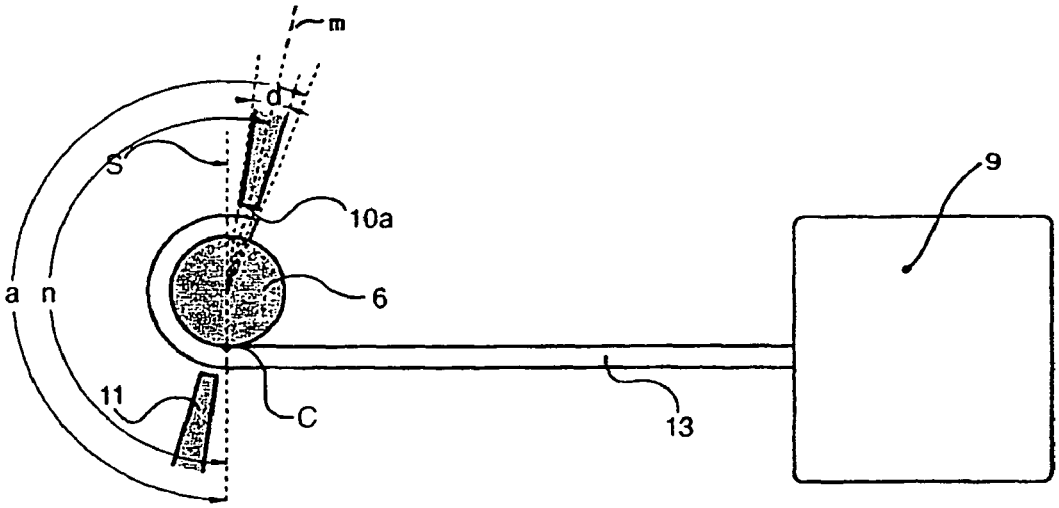
FIG. 5 is a view similar to the one appearing in FIG. 4, in which the details and characteristics of some geometrical features of the inventive apparatus are however particularly emphasized.

To such a purpose, the following advantageous improvement is therefore introduced: with reference to FIG. 4, let S be used to indicate the half-line which, orthogonal to the axis X of the rod 6 and passing through said axis, passes also through the point of contact C of the wire section 13 coming from the wire carriage 9; from this point of contact C, said half-coil 4 is wound around said rod 6 by an angle a that is adequately greater than 180°, by such an extent as indicated and explained below. Furthermore, let the terminal portion of said first half-coil 4 be indicated by the reference numeral 14.

In the following description, unless otherwise indicated, the angles will be defined in a clockwise direction starting from said half-line S, clearly illustrated in the Figures.

Furthermore, the angular orientation of said two vices 10 and 11, along with the respective contact surfaces 10*a* and 11*a* thereof, is such that one of said vices 10 comes into contact with at least part of the surface area 10*a* with the terminal portion 14 of said half-coil 4; this means that the orientation of the median axis m of the contact area 10*a* of said vice 10 must be certainly greater than 180° (as measured from the contact point C).

In particular, and preferably, it must be ensured that the entire area 10*a* actually rests on the coil, which in other words means that no portion of said area 10*a* must be able to protrude unsupported from said terminal portion 14, i.e. that the entire such area 10*a* rests on the wire in the zone of the half-coil 4 that is comprised in the angle from 180° to (180°+a). On the other hand, this also ensures that even the opposite vice 11 will rest in the curved zone of the half-coil 4.

This condition may be considered as fulfilled if, indicating with n the angle of the bisecting line m of the area 10*a* from said point of contact C, and indicating with d the amplitude of the angle of said contact surface 10*a*, following relationships result (FIG. 5):

$$n-d/2>180° \text{ and}$$

$$n+d/2<a.$$

This last improvement enables all of the drawbacks indicated under a) through to d) earlier in this description to be almost completely eliminated, thereby reaching the basic aim of the present invention.

Figure 6:
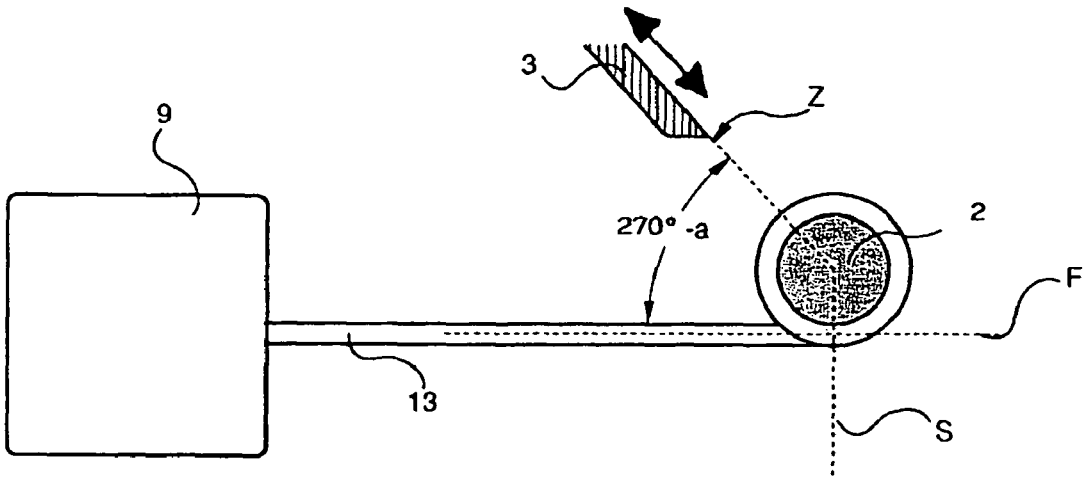
FIG. 6 is a plane view of the cutting station 1, as viewed substantially from the axis X of the rod or core, in the apparatus shown in FIG. 1.

As far as the way in which said first half-coil 4 is cut with said angle a significantly greater than 180°, reference should be now made to FIG. 6, which illustrates a front view of said first working station 1 as viewed from said second working station 5. The support member 2, which is known to be just slightly deeper than a coil, is of course engaging the last coil of the spring having just been wound, as transferred thereto from the wire carriage 9. Since the reference direction F is, by construction, the direction of the axis of the wire 13 moving out of the wire carriage 9, the cutting means 3 must obviously be capable of moving its blade towards said support member 2 along a sectioning plane z having an angle, relative to the wire 13, of precisely (270°—a), i.e. at an angle that is substantially lower than 90°; such feature can therefore be implemented without any technical difficulty and, ultimately, enables a first half-coil to be formed having an angle that is sufficiently great to allow for the application of both said vices 10 and 11 thereupon, as well as to allow for said two vices to be positioned in such a manner as to ensure that both of them are applied onto the curved portion of the same half-coil, thereby creating the technical conditions enabling the desired results of the present invention to be attained.

The invention claimed is:

1. An apparatus for producing spirally wound springs from a wire, the apparatus comprising:

a first working station including:

a wire support member substantially cylindrical in shape and adapted to be partially wound by the wire; and a cutter adapted to cut the wire against said wire support member;

a second working station including:

a rod for supporting the wire and for winding the wire; and a pair of vices for clamping and securing the wire, said pair of vices disposed at an end portion of said rod and arranged in respective diametrically opposed positions with respect to a longitudinal axis of said rod, and each vice of said pair of vices being displaceable radially with respect to said rod; and a wire carriage for feeding the wire to said second working station, and adapted to transfer wire from said first working station to said second working station by a displacement in a direction substantially parallel to the longitudinal axis of said rod.

2. The apparatus according to claim 1, wherein each vice of said pair of vices has a planar surface portion or a slightly concave surface portion facing said rod.

3. The apparatus according to claim 2, wherein said cutter is adapted to cut the wire along a plane extending radially with respect to said support member, and wherein an angle between a line along which said cutter cuts the wire and a line along the direction of the wire fed from said wire carriage is less than 90 degrees.

4. The apparatus according to claim 1, wherein said pair of vices is adapted to secure the wire by clamping the wire in a position such that an angle over which the wire contacts a surface of said rod is greater than 180 degrees.

5. The apparatus according to claim 4, wherein an entire contact area of a first vice of said pair of vices with the wire is comprised within a terminal portion of the wire.

6. The apparatus according to claim 1, wherein said cutter is adapted to cut the wire along a plane extending radially with respect to said support member, and wherein an angle between a line along which said cutter cuts the wire and a line along the direction of the wire fed from said wire carriage is less than 90 degrees.

7. A method for producing spirally wound springs from a wire, the method comprising the steps of:

cutting an end portion of the wire wound at less than a complete turn or coil;

displacing the end portion of the wire onto a rod;

clamping two diametrically opposed portions of the wire against the rod to secure the end portion of the wire against the rod;

rotating the rod while displacing the wire so as to form a spirally wound spring;

unclamping an end portion of the spirally wound spring from the rod; and returning the spirally wound spring to a cutting station.

8. The method according to claim 7, wherein said clamping is via members having substantially planar outer surfaces or substantially concave outer surfaces contacting the wire.

9. The method according to claim 8, wherein one portion of the two diametrically opposed portions of the wire is a terminal portion of the wire, and an angle over which the one portion contacts a surface of the rod is greater than 180 degrees.

10. The method according to claim 8, wherein said cutting is performed at an end of the wire wound around a support member, and wherein the cutting section is selected so that an angle over which the end portion contacts a surface of the rod is greater than 180 degrees.

11. The method according to claim 10, wherein one portion of the two diametrically opposed portions of the wire is a terminal portion of the wire, and an angle over which the one portion contacts a surface of the rod is greater than 180 degrees.

12. The method according to claim 7, wherein said cutting is performed at an end of the wire wound around a support member, and wherein the cutting section is selected so that an angle over which the end portion contacts a surface of the rod is greater than 180 degrees.

13. The method according to claim 12, wherein one portion of the two diametrically opposed portions of the wire is a terminal portion of the wire, and an angle over which the one portion contacts a surface of the rod is greater than 180 degrees.

14. The method according to claim 7, wherein one portion of the two diametrically opposed portions of the wire is a terminal portion of the wire, and an angle over which the one portion contacts a surface of the rod is greater than 180 degrees.

* * * * *